US010276929B2

(12) United States Patent
Meyer et al.

(10) Patent No.: US 10,276,929 B2
(45) Date of Patent: Apr. 30, 2019

(54) DEVICE FOR RECEIVING MICROWAVE RADIATION

(71) Applicant: Robert Bosch GmbH, Stuttgart (DE)

(72) Inventors: Johannes Meyer, Boeblingen (DE); Matthias Steinhauer, Steinheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 168 days.

(21) Appl. No.: 15/373,833

(22) Filed: Dec. 9, 2016

(65) Prior Publication Data

US 2017/0179586 A1 Jun. 22, 2017

(30) Foreign Application Priority Data

Dec. 17, 2015 (DE) ..... 10 2015 225 578

(51) Int. Cl.

| | |
|---|---|
| ***H01Q 1/32*** | (2006.01) |
| ***H01Q 1/36*** | (2006.01) |
| ***H01Q 1/42*** | (2006.01) |
| ***H01Q 15/02*** | (2006.01) |
| ***H01Q 21/24*** | (2006.01) |
| ***H01Q 1/38*** | (2006.01) |
| ***H01Q 15/08*** | (2006.01) |
| ***H01Q 15/24*** | (2006.01) |
| ***H01Q 21/08*** | (2006.01) |

(52) U.S. Cl.

CPC ..... *H01Q 1/3283* (2013.01); *H01Q 1/36* (2013.01); *H01Q 1/38* (2013.01); *H01Q 1/42* (2013.01); *H01Q 15/02* (2013.01); *H01Q 15/08* (2013.01); *H01Q 15/24* (2013.01); *H01Q 21/08* (2013.01); *H01Q 21/245* (2013.01)

(58) Field of Classification Search

CPC ..... H01Q 1/325; H01Q 1/3291; H01Q 3/46; H01Q 15/148; H01Q 15/24; H01Q 9/0407; H01Q 9/0428; H01Q 19/005; H01Q 21/065

USPC ..... 343/713

See application file for complete search history.

(56) References Cited

U.S. PATENT DOCUMENTS

| | | | | |
|---|---|---|---|---|
| 5,915,020 | A * | 6/1999 | Tilford | H04B 1/3827 348/838 |
| 6,396,449 | B1 * | 5/2002 | Osterhues | H01Q 3/44 343/754 |
| 7,187,334 | B2 * | 3/2007 | Franson | H01Q 1/3233 343/700 MS |
| 2004/0227687 | A1 * | 11/2004 | Delgado | H01Q 1/42 343/872 |

(Continued)

OTHER PUBLICATIONS

Menzel, Wolfgang et al., "Millimeter-Wave Folded Reflector Antennas with High Gain, Low Loss, and Low Profile"IEEE Antennas and Propagation Magazine, Jun. 2002, vol. 44, No. 3, 24-28.

*Primary Examiner* — Hoang V Nguyen
*Assistant Examiner* — Awat M Salih
(74) *Attorney, Agent, or Firm* — Norton Rose Fulbright US LLP; Gerard Messina

(57) ABSTRACT

A device including a receiving antenna on a circuit board and a radome, multiple reflections of the received signals between the radome and the receiving antenna being avoided by using a polarization-rotating structure on the circuit board. The device may in particular be an integral part of a distance controller for adaptive cruise control of a motor vehicle.

13 Claims, 2 Drawing Sheets

(56) References Cited

U.S. PATENT DOCUMENTS

| | | | | |
|---|---|---|---|---|
| 2006/0244670 | A1* | 11/2006 | Chekroun | H01Q 3/22 343/770 |
| 2007/0001918 | A1* | 1/2007 | Ebling | G01S 13/931 343/753 |
| 2007/0057850 | A1* | 3/2007 | Yang | H01Q 21/065 343/700 MS |
| 2010/0039346 | A1* | 2/2010 | Peter | H01Q 1/40 343/872 |
| 2011/0109524 | A1* | 5/2011 | Saily | H01Q 21/08 343/893 |
| 2012/0112976 | A1* | 5/2012 | Hayakawa | H01Q 9/045 343/767 |
| 2014/0118220 | A1* | 5/2014 | Ley | H01Q 19/19 343/912 |
| 2014/0132448 | A1* | 5/2014 | Bradstreet | H01Q 25/02 342/362 |
| 2015/0162658 | A1* | 6/2015 | Bowers | H01Q 15/006 342/385 |

* cited by examiner

DEVICE FOR RECEIVING MICROWAVE RADIATION

CROSS REFERENCE

The present application claims the benefit under 35 U.S.C. § 119 of German Patent Application No. DE 102015225578.6 filed on Dec. 17, 2015, which is expressly incorporated herein by reference in its entirety.

FIELD

The present invention relates to a device which includes a receiving antenna on a circuit board and a radome, multiple reflections of the received signals between the radome and the receiving antenna being avoided by using a polarization-rotating structure on the circuit board. The device may in particular be an integral part of a distance controller for adaptive cruise control of a motor vehicle.

BACKGROUND INFORMATION

The paper "Millimeter-Wave Folded Reflector Antennas with High Gain, Low Loss, and Low Profile" by Wolfgang Menzel, Dietmar Pilz and Maysoun Al-Tikriti, June 2002 in the IEEE Antennas and Propagation Magazine, Vol. 44, No. 3, pages 24-28, describes applying reflective metal structures to a circuit board in order to construct a reflector antenna for millimeter waves.

SUMMARY

In accordance with the present invention, a receiving antenna for microwaves or millimeter waves is provided, which includes an antenna structure that is applied to a circuit board and also a radome which protects the receiving antenna from soiling or the effects of weather. The radome may have a focusing property for the frequency ranges of interest, so that the radome acts as a lens. In this case, the radome is designed as a lens. It is also possible that the radome is made up of a non-focusing radome and a focusing lens. One disadvantage with such systems is that incident receiving beams pass the radome, are reflected on the circuit board, and the reflected received waves are reflected again on the inner surface of the radome and/or of the optionally provided dielectric lens, resulting in multiple reflections between the circuit board, which carries the receiving antenna, and the radome or the lens. These multiple reflections result in interferences in the received signal of the antenna, which may impair the reception quality and may even make operation of the antenna impossible, similar to reception interferences caused by multipath propagation of the signals.

In accordance with the present invention, these multiple reflections may be avoid, and thus the present invention may improve the reception quality of the microwave antenna or the millimeter wave antenna. According to the present invention, this takes place in that multiple reflections of the received signals between the radome and the receiving antenna are avoided by using at least one polarization-rotating structure on the circuit board according to the present invention.

Advantageous refinements and embodiments result from the description and figures herein.

The multiple reflections are caused by reflections of the received signals on metal surfaces of the circuit board and by reflections on the inner surface of the radome. In the context of the present invention, reflections between the circuit board, which carries the receiving antenna, and an inner surface of the radome are advantageously to be avoided. Various surfaces may be regarded as the inner surface of the radome. For instance, it is often customary nowadays to close the receiving antenna with the aid of a sensor housing cover, whereby the sensor housing cover at the same time takes on the function of a radome. Such a device may be installed behind bumpers of a vehicle, whereby the bumper or another body component may serve likewise as a further radome.

In the context of the present invention, the reflection between the circuit board and any inner surface of the radome is meant according to the possibilities described above. Even in the case of constructions in which the sensor housing is open toward the front and is integrated directly into the rear side of body components, for example in that a semi-open radar sensor housing is clipped, glued or molded directly onto the rear side of a bumper or of a body component, reflections between the circuit board, which carries the receiving antenna, and the body component acting as the radome may in principle occur and may be avoided according to the present invention.

It may advantageously also be provided that the polarization-rotating structure is formed of a plurality of regularly arranged metal shapes on the circuit board of the receiving antenna. For effective suppression of multiple reflections which, depending on the operating state, may be caused by received waves impinging from different directions, it is advantageous that the polarization-rotating structure is applied preferably to many free surfaces of the circuit board in order to be able to destroy as much reflected power as possible and to be able to suppress the reflections even in the case of variable reflection points on the circuit board in preferably many directions. In particular, the arrangement as a field of reflection-rotating structures, for example configured as an array, may be of particular advantage here.

It may therefore be particularly advantageous if the polarization-rotating structure, which is formed of regularly arranged metal shapes, is configured as an array arrangement.

It is also advantageous if the array structure for rotating the polarization is recessed at the locations on the circuit board at which antenna patches of the receiving antenna are situated. By virtue of this feature, it is possible to produce the antenna patches and also the polarization-rotating structures in the same plane of the circuit board with the aid of the same etching step. Since this metallization plane for producing the patch antennas has to be structured and etched in any case, it is particularly cost-effective and easy to additionally structure the existing metal surface in the same working step so that the polarization-rotating structures are produced by the etching step that is necessary in any case. As a result, there is no increase either in the manufacturing costs of the sensor or in the number of process steps required during manufacture.

It is also advantageous if the polarization-rotating structure is a rectangular metal surface or multiple rectangular metal surfaces. By virtue of the one or multiple rectangular metal surface(s), it is possible to optimize the polarization-rotating structures to particular frequency ranges of the incident signals. It is also advantageous that the one rectangular metal surface of the polarization-rotating structure or the multiple rectangular metal surfaces of the polarization-rotating structure is/are rotated by 45° in terms of their orientation relative to the patches of the receiving antenna. The purpose of the 45° orientation to the antenna patches is that the polarization of the received wave, i.e., the sum field vector, is correspondingly rotated by 45° relative thereto. By breaking down this field vector into its orthogonal components and by the different reflection phase of the polarization-rotating patches for these two components, a 90° rotation of the polarization is obtained in the reflected sum field vector. As a result, the signals reflected back for example at a bumper are then rotated by 90° relative to the direction of polarization of the signals received by the receiving antenna and are greatly suppressed.

It is also advantageous if the antenna is a receiving antenna for microwave radiation or millimeter wave radiation. Specifically, in this frequency range, in which reflection and wave propagation function in a manner similar to optical light waves, the avoidance of undesirable multiple reflections may be effectively used according to the present invention.

It is also advantageous if the radome has a focusing unit for the received signals which are received by the receiving antenna. As the focusing unit, for example, a dielectric lens may be used which is formed in one piece with the radome. To this end, the radome may have lens-shaped thickenings of the radome material, as a result of which the received signals are refracted and the received signals are concentrated on the receiving antenna, which is usually small in size. The focusing unit may in this case also be designed as a Fresnel lens, which has the effect of saving material and weight.

According to one specific embodiment, it is also possible to form the receiving antenna, instead of with a lens, only with a radome which has no focusing unit. It is also possible to provide multiple radomes or, in addition to the radome or radomes, additionally to provide a focusing unit in the beam path in the form of a dielectric lens. With particular advantage, the focusing unit of the radome may be designed as a dielectric lens.

It is also advantageous if the radome is a bumper or part of a bumper of a motor vehicle, since in this case the transmitting and receiving device for microwave radiation or millimeter wave radiation may be invisibly fastened behind the radome or the radomes on the front of a vehicle.

It is also advantageous if the receiving antenna is an integral part of a distance controller for adaptive cruise control of a motor vehicle. With adaptive cruise control, the driver of a motor vehicle may set a setpoint speed which the vehicle maintains when travelling on a clear road. If a preceding slower vehicle is detected, the speed to be maintained is reduced by the adaptive cruise control so that the host vehicle follows the preceding vehicle at approximately the same speed and at a constant distance. When the preceding vehicle disappears, for example by turning off or changing to an adjacent lane, the originally set setpoint speed is then maintained again. Such systems require a transmitter and a receiver, often also configured in a combined manner as a transceiver, for detecting objects ahead and for ascertaining the relative speed and distance thereof in relation to the host vehicle. Since such applications may also be safety-relevant, it is necessary that reliable functioning is ensured and that reflections are ruled out as far as possible.

Further features, possible uses and advantages of the present invention result from the following description of exemplary embodiments of the present invention, which are shown in the figures. All described or illustrated features, alone or in arbitrary combination, form the subject matter of the present invention regardless of their wording in the description and representation in the figures.

BRIEF DESCRIPTION OF THE DRAWINGS

Exemplary embodiments of the present invention are explained below with reference to the figures.

DETAILED DESCRIPTION OF EXAMPLE EMBODIMENTS

Figure 1:
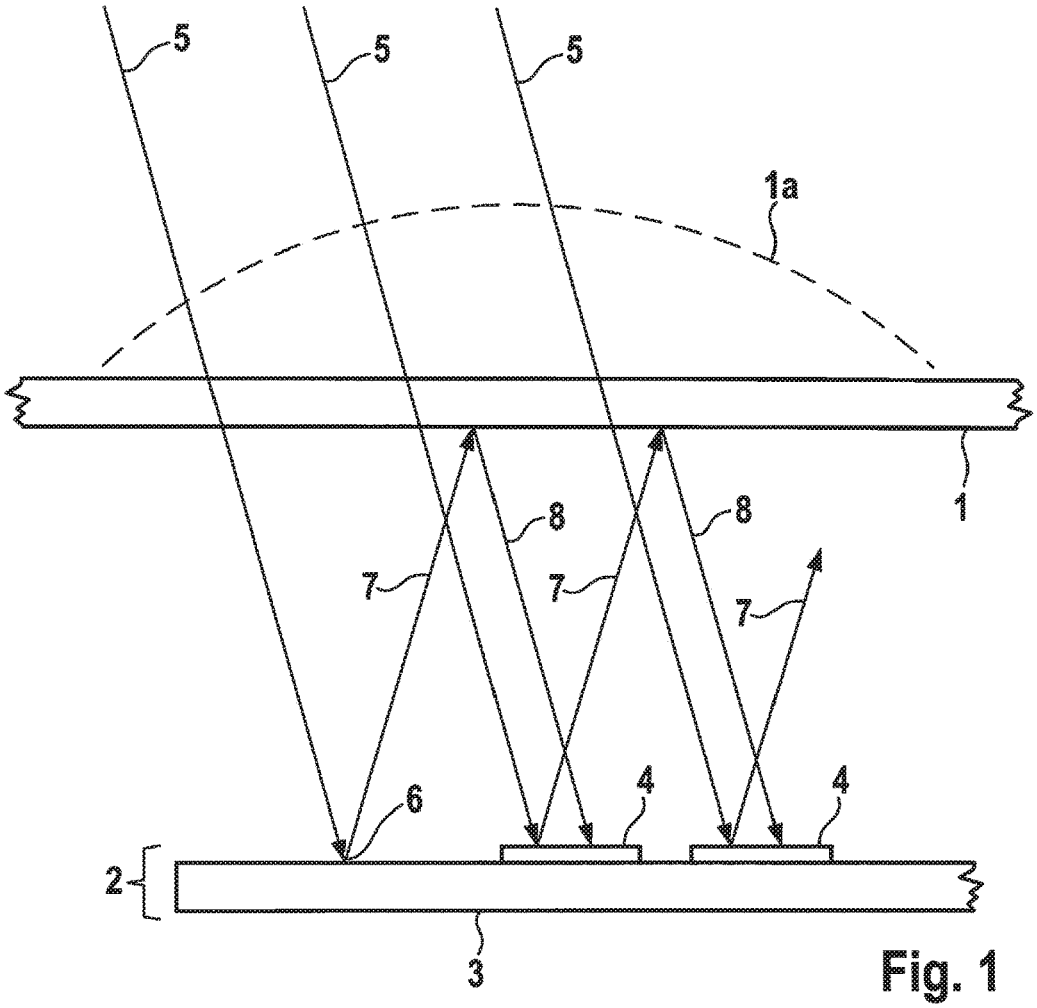
FIG. 1 shows an exemplary side view through an arrangement of a circuit board and a radome to explain the multiple reflections.

FIG. 1 schematically shows main components of a receiving device. For instance, a receiving antenna structure 2 having a circuit board 3 is shown, to which a receiving antenna is applied, whereby the receiving antenna 2, as shown, may be configured as a patch antenna by small metal surfaces on the top side of circuit board 3. Such patch antennas are widely used for transmitting and/or receiving microwave radiation or millimeter wave radiation and are easy to produce. This circuit board is protected from its surroundings by a housing part 1, which protects circuit board 3 from the effects of weather, dust and dirt and ensures long-term functional capability. Such a housing part is often referred to as a radome 1, which has been made, for example, of a material that is transparent to electromagnetic waves. In the automobile sector, such microwave or millimeter wave sensors are often situated behind body components in a manner that is invisible to other road users, so that it may be advantageous, in addition or as an alternative to the described radome 1, to produce a body component likewise from a material that is transparent to electromagnetic radiation. It may also be provided that radome 1 or body component 1, which may take over the function of a radome 1, includes a focusing unit 1*a*. In this case, radome 1 is not only transparent to electromagnetic radiation, but also the received electromagnetic radiation is additionally refracted by the focusing unit and bundled onto receiving antenna 2. With such a construction, it may happen that received waves 5 incident as plane waves impinge at a non-perpendicular angle through radome 1 or through the radome including focusing unit 1*a* and are reflected on circuit board 3 at a reflection point 6. Such reflections on the surface of the circuit board generate a reflected beam 7 which has the same angle of reflection as incident received beam 5. If reflected beam 7 once again passes through the radome 1, it is emitted into the surroundings and does not cause interference for the received signal of receiving antenna 2. Only the reduced power of the received signal is decreased as a result. With certain angles of incidence or certain choices of material, it is also possible that reflected beam 7 is reflected again on the inside of radome 1 or on the inside of the radome including focusing unit 1*a* and is fed as a double-reflected beam 8 to the patches of receiving antenna 2. If both a radome 1 without a focusing unit and a radome including a focusing unit 1*a* are provided in the beam path, the signal that has already been reflected may be reflected again multiple times on each of these surfaces as a result. Due to the described types of multiple reflections, signals are produced whose sub-signals have different phase positions, as a result of which these received signals influence each other in such a way that the received signal of receiving antenna 2 is considerably impaired. In order to avoid this effect, it is provided to suppress reflected beams 7 as far as possible, so that also double-reflected beams 8 are suppressed. This takes place in that reflection points 6 on the circuit board, which are potentially present at any location on the circuit board, are equipped with polarization-rotating structures 4, and in this way reflections of received waves 5 on circuit board 3 are largely avoided.

Figure 2:
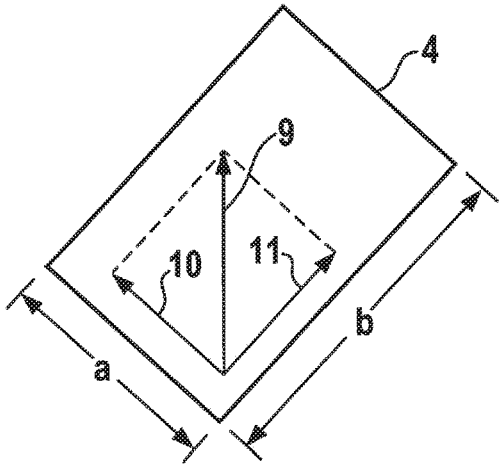
FIG. 2 shows an exemplary embodiment to explain the functioning of an individual patch as a polarization-rotating structure.

FIG. 2 shows a rectangular structure 4, the two edges of which are orthogonal to one another but are situated diagonally at an angle of approximately 45° to the horizontal and to the vertical.

It is possible to see the smaller side edge a and the longer side edge b of the rectangle. Such a rectangle, the edges of which are situated approximately diagonally to the horizontal, forms a basic shape of polarization-rotating structure 4. If an incident received wave 5 impinges on such a polarization-rotating structure 4, the E-vector 9 of incident wave 5 is located approximately perpendicular to the horizontal, as illustrated by perpendicular arrow 9. Since polarization-rotating structure 4 has been made of electrically conductive material, for example a copper layer on circuit board 3, the E-vector 9 may be broken down into a component 10 in parallel to the short edge a and into a second vector component 11 in parallel to the long edge b. Since dimensions a and b are tailored approximately to the middle frequency of the microwave signal or millimeter wave signal 5 that is to be received and polarization-rotating structure 4 has no connections, received wave 5 is reflected but is rotated by 90° in terms of its polarization. Ideally, the polarization of the wave that is reflected multiple times is oriented at 90° to the polarization of the receiving antenna and is thus almost completely suppressed. By virtue of this measure, the signal-to-noise ratio between useful signal and multi-reflected interference signal may be increased, which improves the reception quality of receiving antenna 12.

Figure 3:
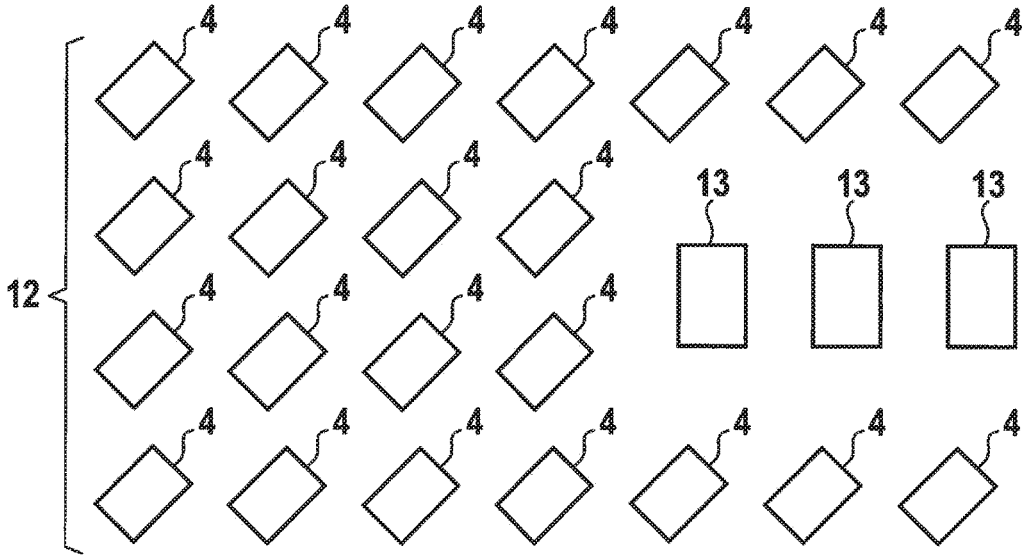
FIG. 3 shows an array of patches as a polarization-rotating structure, where this is recessed for the receiving antenna.

FIG. 3 shows a further specific embodiment of polarization-rotating structure 4. In FIG. 3, a large number of the diagonally oriented rectangles have been arranged in an array form so that these form a regularly repeating pattern in rows and columns. As is apparent, this so-called array arrangement 12 of individual rectangles 4 is situated on all free surfaces of circuit board 3, as a result of which they are most effective against the described reflections. Only for areas, in which patches 13 for receiving antenna 12 are provided, is it advantageous to recess array structure 12 and to arrange receiving patches 13 of receiving antenna 2 at the recessed locations, which is shown in the right-hand half of FIG. 3. As a result, it is possible to take an effective measure to suppress multipath reflections of received signals 5 between circuit board 3 and radome 1 without additional costs and without additional manufacturing steps.

Figure 4:
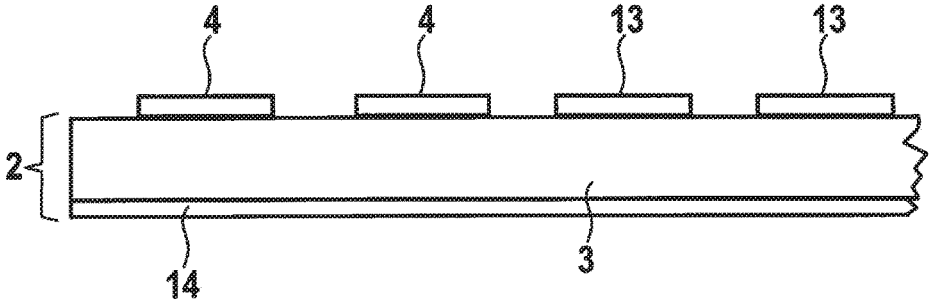
FIG. 4 shows a cross-section through an advantageously designed circuit board.

FIG. 4 shows the cross-section through a circuit board according to the present invention. It is possible to see receiving antenna 2, which includes a circuit board with multiple layers of metallization.

The structuring usually takes place by coating with photoresist, exposing the latter to light and etching away the exposed photoresist areas. After removing the excess photoresist, a metallization layer remains only at the desired areas so that the desired circuits or elements have been structured. In the cross-section as shown in FIG. 4, circuit board 3 is apparent, which has a metallization layer both on the top side and on the bottom side. The metallization layer on the top side has been structured by etching out both patches 13 for receiving antenna 2, which are structured orthogonally in top view according to FIG. 3, and polarization-rotating structures 4 which likewise have a rectangular basic shape and the side edges of which are oriented diagonally in top view. Such receiving patches 13 and polarization-rotating structures 4 are illustrated by their flat cross-section on the top side of circuit board 3. The bottom side of circuit board 3, which likewise has a metallization plane 14, may be left unstructured as shown, so that a continuous metal layer of copper material is present. Such a continuous metal layer 14 has the advantage that electromagnetic reflections and emissions on the top side of circuit board 3 are shielded and further elements of the receiving antenna, such as for example filters, sampling elements or A/D converters, are rarely affected by interference signals. Usually, circuit boards 3 are produced with one or more layers of metallization and these metallization layers are structured in the course of the manufacturing process. For the sake of clarity, one circuit board substrate 3 and one metallization on top side 4, 13 and on bottom side 14 are shown in FIG. 4. The circuit board structure may in this case also be formed of a multilayer circuit board, optionally also of a multilayer circuit board including a high-frequency substrate on one of the two sides. In this case, it is significant that the metallization plane is not necessarily applied to the side facing away from the antenna but rather may also be provided in one of the intermediate layers.

What is claimed is:

1. A device, comprising:

a receiving antenna for microwaves or millimeter waves on a circuit board; and a radome;

wherein a polarization-rotation structure is provided on the circuit board for avoiding multiple reflections of received signals between the radome and the receiving antenna, wherein the radome includes a focusing unit for the received signals which are received by the receiving antenna, and wherein the radome is transparent to electromagnetic radiation and to received electromagnetic radiation that is refracted by the focusing unit and bundled onto the receiving antenna, so that received waves incident as plane waves impinge at a non-perpendicular angle through the radome or through the radome and the focusing unit and are reflected on a surface of the circuit board at a reflection point, and wherein such reflections on the surface of the circuit board generate a reflected beam which has a same angle of reflection as the received waves, and wherein another radome without a focusing unit and the radome and the focusing unit are provided in the beam path, so that the signal that has already been reflected is reflected again multiple times on each of the surfaces as a result, wherein it is provided to suppress the reflected beams, so that double-reflected beams are suppressed, and wherein suppression occurs at reflection points on the circuit board, which includes polarization-rotating structures, so that reflections of the received waves on the circuit board are reduced.

2. The device as recited in claim 1, wherein the multiple reflections are caused by reflections of the received signals on metal surfaces of the circuit board and by reflections on the inner surface of the radome.

3. The device as recited in claim 1, wherein the polarization-rotating structure includes a plurality of regularly arranged metal shapes on the circuit board of the receiving antenna.

4. The device as recited in claim 3, wherein the regularly arranged metal shapes are an array arrangement.

5. The device as recited in claim 4, wherein the array arrangement is recessed at the locations on the circuit board at which antenna patches of the receiving antenna are situated.

6. The device as recited in claim 1, wherein the polarization-rotating structure is a rectangular metal surface or multiple rectangular metal surfaces.

7. The device as recited in claim 6, wherein the rectangular metal surface of the polarization-rotating structure or the multiple rectangular metal surfaces of the polarization-rotating structure are rotated by 45° in terms of their orientation relative to antenna patches of the receiving antenna.

8. The device as recited in claim 1, wherein the antenna is a receiving antenna for microwave radiation or millimeter wave radiation.

9. The device as recited in claim 1, wherein the focusing unit of the radome is a dielectric lens.

10. The device as recited in claim 1, wherein the radome is a bumper or part of a bumper of a motor vehicle.

11. The device as recited in claim 1, wherein the receiving antenna is an integral part of a distance controller for adaptive cruise control of a motor vehicle.

12. The device as recited in claim 1, wherein when a reflected beam once again passes through the radome, it is emitted into the surroundings and does not cause interference for a received signal of the receiving antenna, so that only a reduced power of the received signal is decreased.

13. The device as recited in claim 1, wherein when a reflected beam is reflected again on the inside of the radome or on the inside of the radome and the focusing unit, it is fed as a double-reflected beam to patches of the receiving antenna.

* * * * *